US005819676A

United States Patent [19]

Cwalina

[11] Patent Number: 5,819,676

[45] Date of Patent: Oct. 13, 1998

[54] UNDERWATER ACOUSTIC SEARCH ANGLE SELECTION SYSTEM AND METHOD OF SPECIAL UTILITY WITH SUBMERGED CONTACTS

[75] Inventor: David S. Cwalina, Tiverton, R.I.

[73] Assignee: The United States of America as represented by the Secretary of the Navy, Washington, D.C.

[21] Appl. No.: 885,702

[22] Filed: Jun. 30, 1997

[51] Int. Cl.[6] ..... F42B 19/01

[52] U.S. Cl. ..... 114/21.3; 114/23

[58] Field of Search ..... 114/21.2, 21.3, 114/23; 244/3.11, 3.12

*Primary Examiner*—Charles Jordan
*Assistant Examiner*—Matthew J. Lattig
*Attorney, Agent, or Firm*—Michael J. McGowan; Prithvi C. Lall; Michael F. Oglo

[57] ABSTRACT

A search angle selection system determines acoustic homing beam offset angles to be used by a torpedo from a group of target depth conditions in response to given environmental, tactical, target and weapon information. The system optimally bounds the region that is to be insonified. The system determines the search angle which best insonifies the depth band, that is, the region between the upper depth bound and the lower depth bound, for each search depth, accounting for the weapon's attack angle, including search depths which are not in the depth band itself. For each search depth, the system determines the relative depth separation of the search depth from each of the bounds, and based on this separation an aimpoint which projects from a reference plane through the torpedo is chosen at the depth of each bound. The aimpoint is selected from a table of empirically-determined values. The system modifies the aimpoint when strong negative gradients in the sound velocity profile are present in the ocean environment, and also in the case of strongly conducted rays. A reference insomnification beam axis angle is iteratively determined for each search depth with the axis causing a raypoint which intersects along the respective bound. The pair of reference beam axes whose ray paths intersect the upper and lower bound at the aimpoint for each search depth are averaged to provide the optimal homing beam angle for that search depth.

12 Claims, 6 Drawing Sheets

A

107. SAVE UPPER AND LOWER BOUNDS DETERMINED IN STEP 104
108. ITERATE OVER SEARCH BOUNDS
109. ITERATE OVER SEARCH DEPTH
110. FOR SELECTED SEARCH DEPTH DETERMINE SPEED OF SOUND
111. DETERMINE WHETHER TACTIC IS "UNKNOWN" AND SURFACE DUCT WAS DETERMINED TO EXIST.
F
112. DETERMINE WHETHER SEARCH DEPTH IS SHALLOWER THAN CONJUGATE DEPTH.
NO
YES
G
B

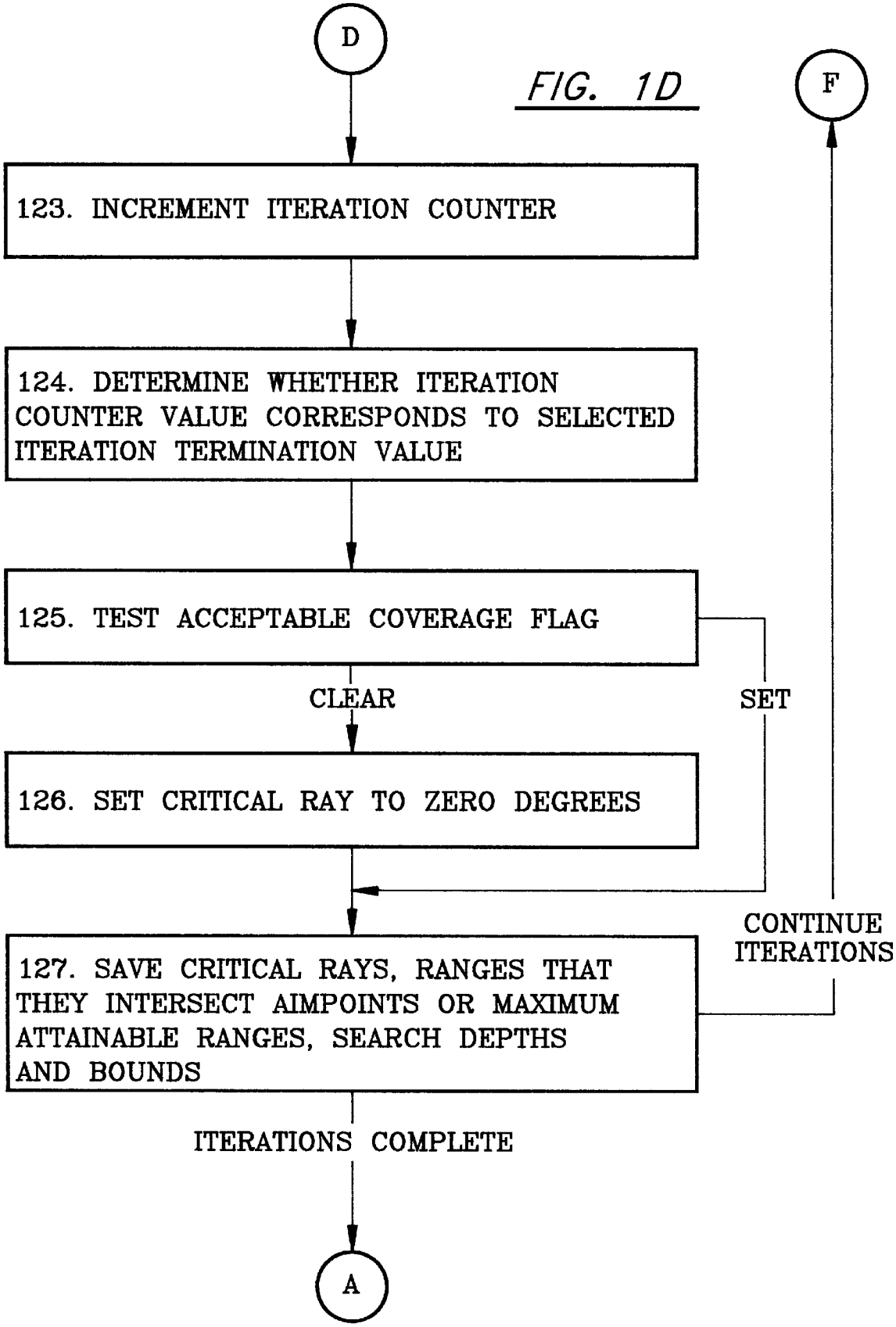
D
FIG. 1D
F
123. INCREMENT ITERATION COUNTER
124. DETERMINE WHETHER ITERATION COUNTER VALUE CORRESPONDS TO SELECTED ITERATION TERMINATION VALUE
125. TEST ACCEPTABLE COVERAGE FLAG
CLEAR
SET
126. SET CRITICAL RAY TO ZERO DEGREES
CONTINUE ITERATIONS
127. SAVE CRITICAL RAYS, RANGES THAT THEY INTERSECT AIMPOINTS OR MAXIMUM ATTAINABLE RANGES, SEARCH DEPTHS AND BOUNDS
ITERATIONS COMPLETE
A

E

128. ITERATE ON SEARCH DEPTHS
129. GENERATE AVERAGE VALUES OF CRITICAL RAYS WHICH INTERSECT AIMPOINTS AT UPPER AND LOWER BOUNDS FOR GIVEN SEARCH DEPTH TO OBTAIN OPTIMAL RAY ANGLE
130. REVISE OPTIMAL RAY ANGLE TO ACCOUNT FOR ATTACK ANGLE
131. GENERATE SEARCH ANGLE WHICH IS NEAREST TO OPTIMAL RAY ANGLE
132. SAVE GENERATED SEARCH ANGLES

UNDERWATER ACOUSTIC SEARCH ANGLE SELECTION SYSTEM AND METHOD OF SPECIAL UTILITY WITH SUBMERGED CONTACTS

STATEMENT OF GOVERNMENT INTEREST

The invention described herein may be manufactured by or for the Government of the United States of America for Governmental purposes without the payment of any royalties thereon or therefor.

CROSS REFERENCE TO RELATED PATENT APPLICATION

The instant application is related to one co-pending U.S. Patent Application entitled UNDERWATER SEARCH ANGLE SELECTION SYSTEM AND METHOD OF SPECIAL UTILITY WITH SURFACE CONTACTS Ser. No. 08/885,700 having same filing date.

BACKGROUND OF THE INVENTION (1) Field of the Invention

The invention relates generally to the field of torpedo weapon order generation and more particularly to systems and methods for selecting target search angles for torpedoes.

(2) Description of the Prior Art

Torpedo performance is characterized by the ability of the torpedo to detect and home in on a target. Target detection is determined by the ability of the torpedo to acoustically differentiate between the target signal and background noise. The probability of target detection can be improved through proper selection of weapon preset settings. Accurate prediction of a weapon's acoustic performance is required so as to select among a large number of possible preset combinations to obtain the set that is optimal. The optimal set determines the search depth for the weapon, the search angle of the weapon, the acoustic mode, the weapon speed, and affects the weapon placement in the horizontal plane. The optimal set is a function of the target and of the particular environmental and tactical scenario. Upon determination of the acoustic presets, they may be provided to the torpedo prior to launch.

A significant problem in the selection of the torpedo acoustic presets is the procedure by which a search or pitch angle is associated with a given search depth. Torpedoes can be preset to search for a target at a fixed number of depths, which are referred to as search depths. They can also be preset to adjust their acoustic beams to a fixed number of off-axis angles called search or pitch angles. Since only one search or pitch angle can be associated with a particular search depth, it is necessary to determine the value which provides the maximum probability of target detection. This value is a function of the environment, the tactical and target scenario, and intrinsic weapon dynamics.

There are several ways in which search angles have been determined. In one way, search angles are provided in table look-ups. Each table is associated with a predefined speed profile and consists of a number of sub-tables, each of which is categorized by whether the search is to be in deep or shallow water, whether the target is a surface ship or submarine, whether there is a high or low target Doppler, high or low sea state, high or low target strength, and whether the target is active or passive. The sub-tables are populated by a list of available search depths, associated search angles, and a probability value identifying the probability that a search will be effective. The pitch angle is selected by exhaustively running all combinations of search depth and search angle on a weapon simulation model and selecting the search angle that provides the highest probability of effectiveness. This exhaustive search can take a relatively long time to complete. In addition, there are deficiencies in developing the tables in a number of areas, including environmental, tactical, target and weapon. For each area, a number of samples are considered, which may be only gross or poor matches for the values which may be encountered in an actual situation.

A second methodology, called the pilot ray algorithm, determines the search angle to associated with each of the torpedo's available search depths. The algorithm accepts tactical information as an input, including selection of the type of tactic as (1) unknown submarine, (2) submarine above the oceanographic layer, (3) submarine below the oceanographic layer, and (4) surface target. In accordance with the algorithm, the oceanographic layer depth is determined (the depth is the depth of maximum sound speed down to a predetermined maximum depth), and a maximum and minimum depth of interest is determined from the selected tactic, the oceanographic layer depth, the target's maximum operating depth, the torpedo's floor setting and the bottom depth. The algorithm iterates over the available search depth settings to determine the search angle. For each search depth a pilot ray is generated, from the sound speed at the search depth and comparing it to the sound speed at the layer depth. If the sound speed at the search depth is less that the sound speed at the layer depth, then Snell's Law of Refraction is used to compute a preliminary pilot ray angle which is the off-axis ray angle which vertexes at the layer depth, but if the sound speed at the search depth is greater than the sound speed at the layer depth, the preliminary pilot ray angle is set to zero. Thereafter a differential depth correction, consisting of a constant multiplied by the difference in depth between the search depth and the mid-depth of the depth band of interest, is added to the preliminary pilot ray angle to develop the final pilot ray angle. The search angle is selected as the angle that is closest to the pilot ray angle.

There are a number of deficiencies in the pilot ray algorithm. First, the algorithm only uses Snell's Law to determine the ray which vertexes at a greater depth, but since the rays are not traced there is no information as to the ranges that the rays achieve when vertexing. In addition, setting the angle to zero if the sound speed at the search depth is greater than the sound speed at the layer depth, essentially ignores the information available in the sound speed profile except for two depths, namely, the search depth and the layer depth. The algorithm also does not account for the weapon's attack angle, the torpedo's ceiling setting and the keel depth of a surface target.

SUMMARY OF THE INVENTION

It is therefore an object of the invention to provide a new and improved search angle selection system and method for submerged targets.

The present invention provides a system and method that receives information regarding the current tactics, target, weapon and environment to generate an optimal search angle for each available search depth for the weapon. The invention generates estimates of the direction to point a narrow beam sonar in order to optimally insonify a depth band in the ocean and to use the direction to determine the torpedo settings which come closest to matching the direction estimates. The depth band is associated with the uncertainty that arises in the depth of a submerged target. The direction to point the sonar is referred to as the "optimal off-axis angle," "critical angle," "critical ray," among others, and is an angle measured vertically up or down. The depth band is defined by the particular scenario, and is defined by an upper bound, as the shallowest depth of interest, and a lower bound, as the deepest depth of interest.

The system provides an output which optimizes the torpedo's likelihood of acquiring a submerged target. The system makes use of inputs including environmental, tactical, target and weapon parameters. The environmental parameters including such information as surface conditions, bottom conditions, and peculiarities in the water column therebetween. The surface conditions include such information as the sea state, wave height and wind speed. The bottom condition corresponds to the depth. The water column is divided into a set of linear segments relating to sound speed gradients in the water.

Tactical information corresponds to "unknown," "above the thermocline layer," "within the thermocline layer" and "surface." The target information corresponds to the type of target (surface ship or submarine), target Doppler, the target's maximum operating depth (for a submarine) or target keel depth (for a surface ship), the target's radiated noise and the acoustic target strength. The unknown tactic refers to an unclassified submarine target. The above-layer tactic refers to target operating between the surface and the most prominent oceanographic layer in the sound speed profile, down to the target's maximum operating depth. The below-layer tactic refers to a target operating below the most prominent oceanographic layer in the sound speed profile down to the target's maximum operating depth. Finally the surface tactic refers to a surface ship target.

Weapon parameters include information as to the weapon's search depths, acoustic mode (active or passive), ceiling, floor, operational depth, search speeds and search angles.

The system receives the above-described parameter values and determines the optimal direction for placement of the acoustic beam pattern for maximal insonification of the depth band which brackets the target's operating depths. The optimal direction is the critical ray or angle. The weapon's search angle which is closest to this critical angle is the system's recommended search angle. The system determines the critical angle from ray theory at the weapon's sonar frequency. A number of sub-models are generated, including a ray trace model based on Snell's Law, an eigenray technique for determining which ray intersects a given range and depth, a model based on empirical data for determining the range/depth eigenpoint, and models of the weapon beam patterns and dynamic constraints. The system combines these sub-models and parameters elegantly to determine the optimal search angle without having to resort to enumeration or approximation techniques.

For a given environmental, tactical, target and weapon scenario, the system bounds the region that is to be insonified. The system determines the search angle which best insonifies the depth band, that is, the region between the upper depth bound and the lower depth bound, for each search depth, accounting for the weapon's attack angle, including search depths which are not in the depth band itself. For each search depth, the system determines the relative depth separation of the search depth from each of the bounds, and based on this separation an aimpoint in range is chosen at the depth of each bound. The aimpoint is selected from a table of empirically-determined values. The system modifies the aimpoint when strong negative gradients in the sound velocity profile are present in the ocean environment, and also in the case of strongly conducted rays. The ray angle which is traced from the search depth and which intersects the range/depth point given by the aimpoint is determined by iteration. The pair of rays that intersect the upper and lower bound for each search depth are averaged to provide the critical rays.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

DESCRIPTION OF THE PREFERRED EMBODIMENT

Figure 1:
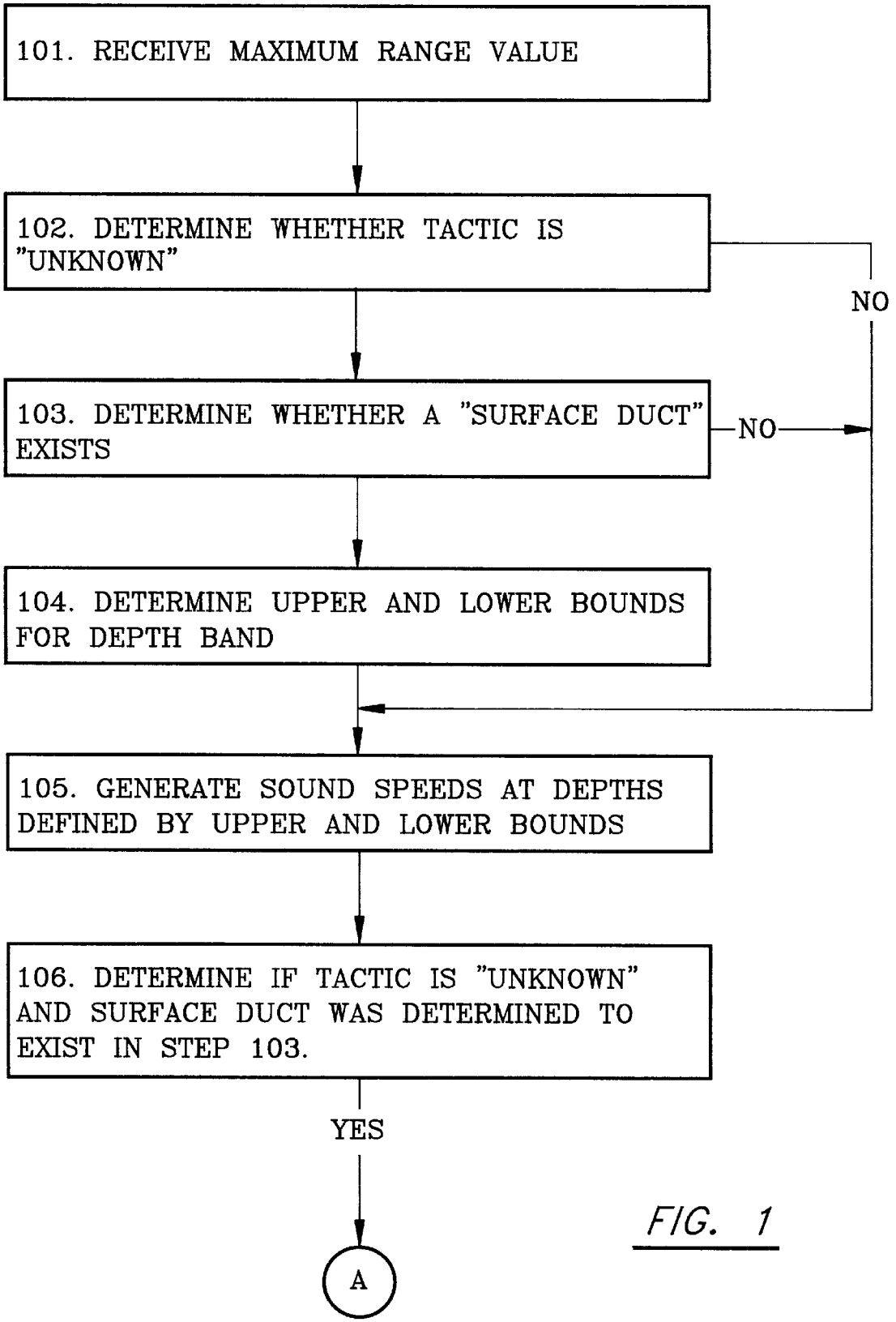
FIG. 1 is a flow diagram depicting operations performed by the search angle selection system in accordance with the invention.
Figure 1A:
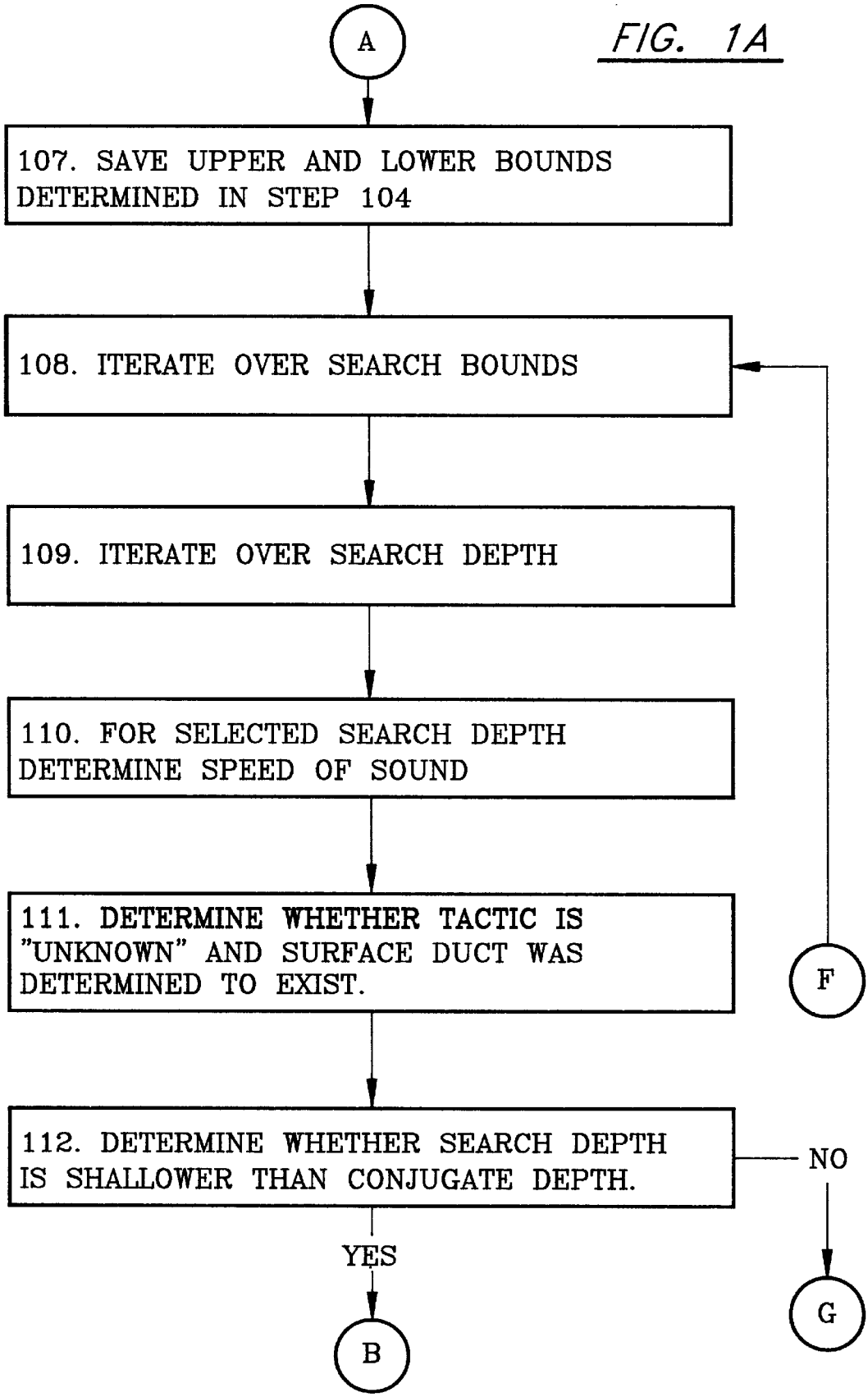
Figure 1B:
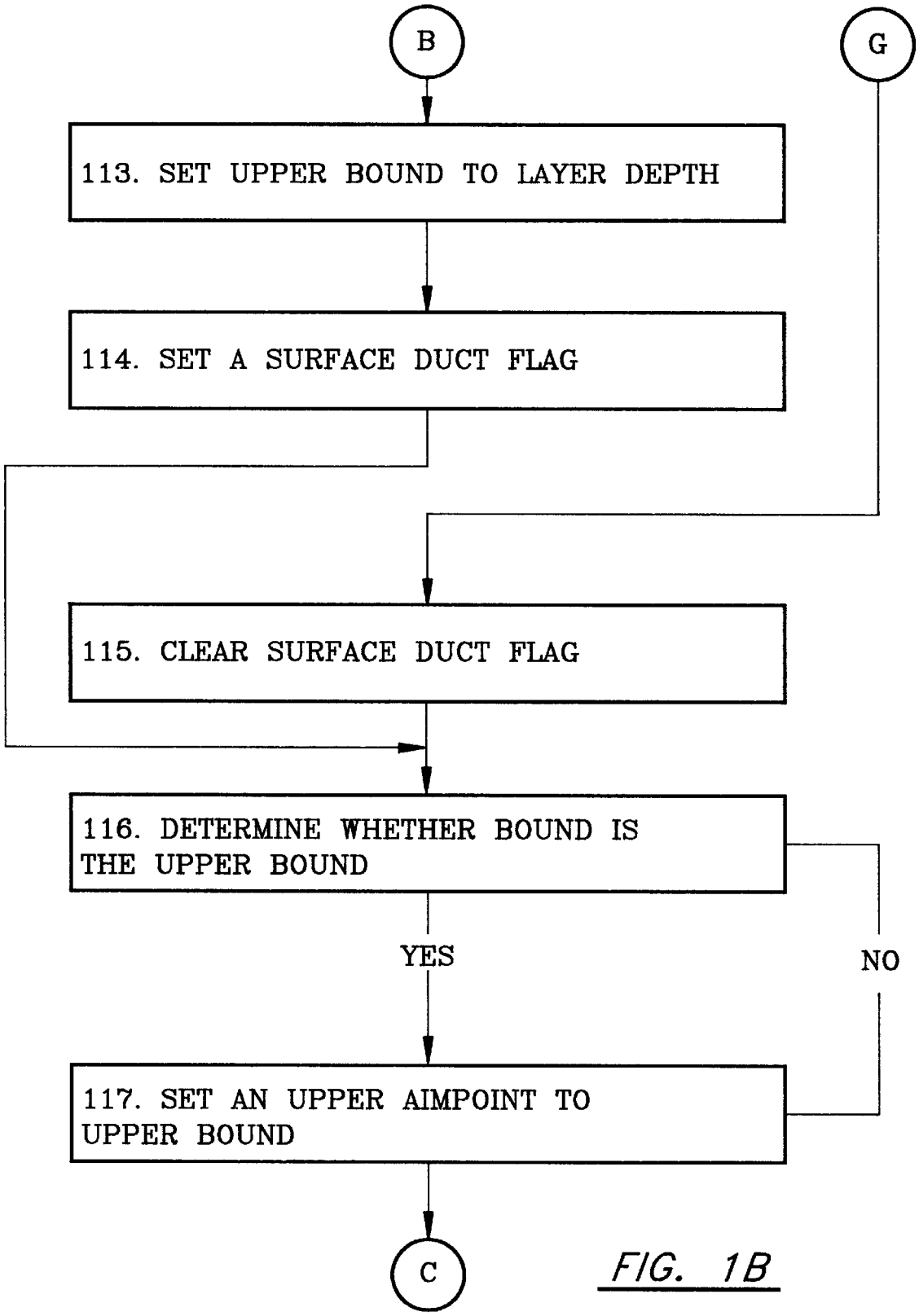
Figure 1C:
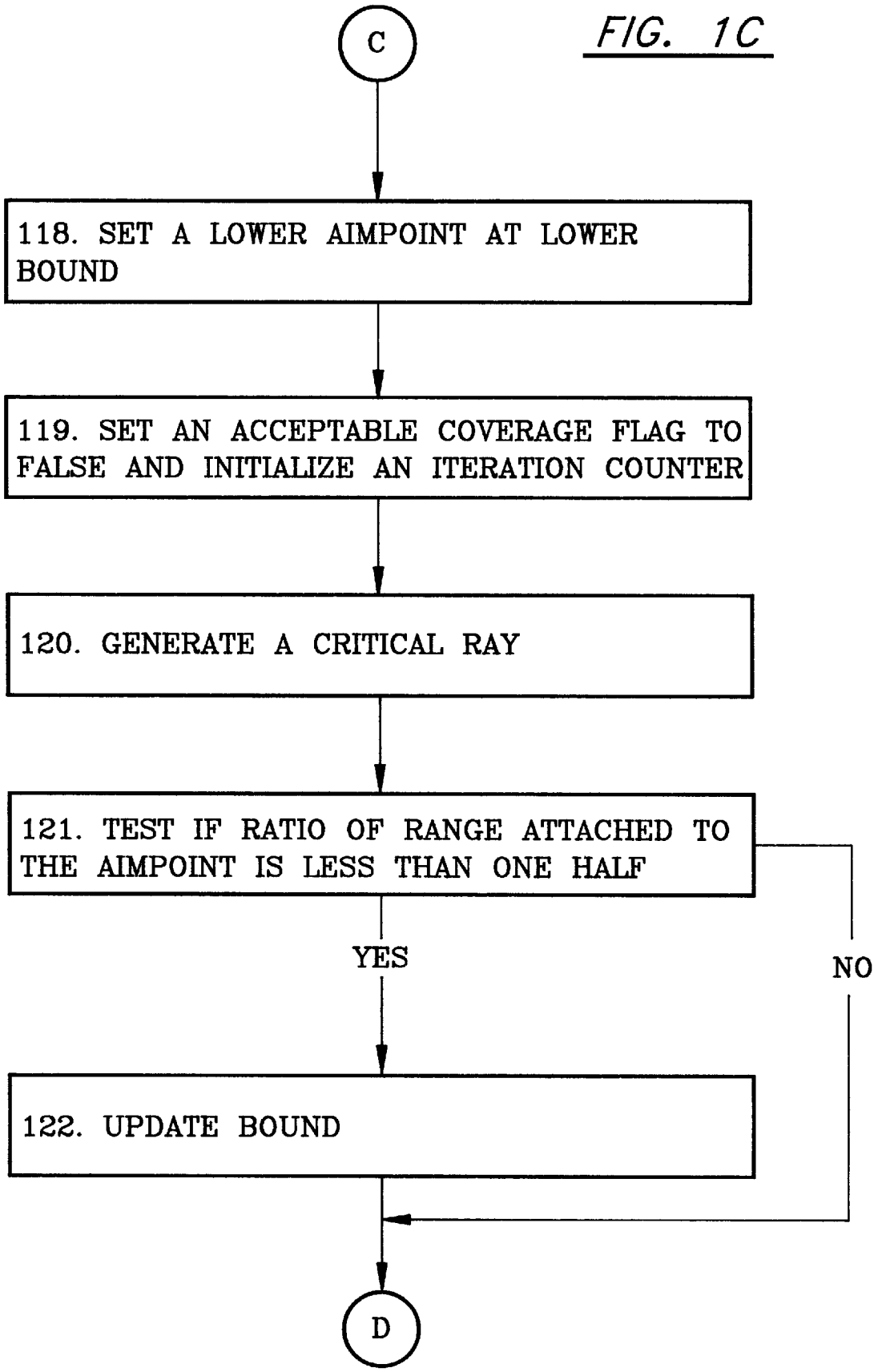
Figure 1E:
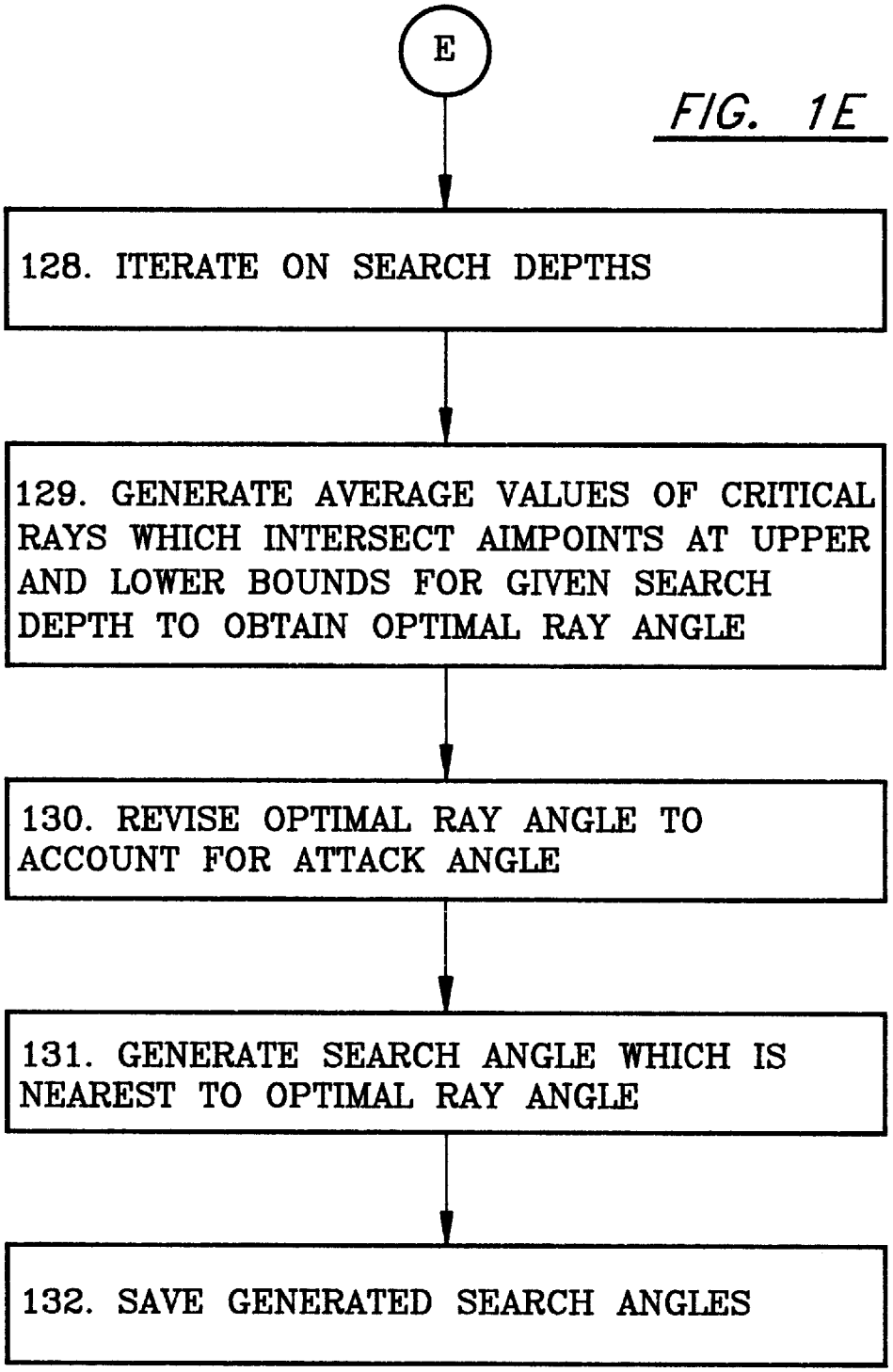

FIG. 1 is a flow diagram depicting operations performed by the search angle selection system in accordance with the invention. It will be appreciated that the operations may be performed by any suitably programmed general purpose computer, which will not be described herein. The search angle selection system whose operations are outlined in FIG. 1 generates search angles for a number of tactics related to assumed depth of sonar contact, including (1) unknown (2) above thermocline layer and (3) below thermocline layer. As defined in dictionaries, a thermocline layer is a layer in a thermally stratified body of water that separates an upper warmer lighter oxygen-rich zone from a lower colder heavier oxygen-poor zone, or, more specifically, a stratum in which temperature declines at least one degree centigrade with each meter in depth. Operations performed by a search angle selection system in connection with a surface tactic are described in the above-identified Cwalina application (Naval Case No. 75870).

With reference to FIG. 1, initially the system is provided with a maximum range to be used in processing (step 101). The maximum range is the longest distance from the torpedo for which the torpedo will acquire a target; for an active torpedo, the maximum range is typically related to a time gate used by the torpedo in a search cycle, and for a passive torpedo the maximum range is related to a propagation loss model. The system then determines whether the tactic is "unknown" (step 102), and if so it determines whether a "surface duct" exists (step 103), that is, it determines whether a strong negative temperature gradient exists which extends from the surface down to a depth below which is a strong positive gradient. The strong positive gradient extends to a depth at which the sound speed is higher than at the surface. The depth at which the sound speed is the same as the sound speed at the surface is known as the "conjugate depth." The system may perform step 103 by determining the strength of the temperature gradients; a typical value which may be used is 0.05 (foot/second)/foot.

Following step 103, or step 102 if the system determines that the tactic is not the unknown tactic, the system determines the upper and lower bounds for the depth band of interest (step 104). The upper bound is (1) either the surface or the torpedo's ceiling setting for the unknown and above layer tactics, or (2) the layer depth for the below layer tactic. The lower bound is (1) the shallower of target maximum operating depth, torpedo floor setting and bottom depth for the unknown and below layer tactics and (2) the layer depth for the above layer tactic. The system then generates the sound speeds at these depths using well known methodologies (step 105). The system then determines if the tactic is unknown and a surface duct was determined to exist in step 103 (step 106) and in response to a positive determination the values for the upper and lower bound determined in step 104 are saved (step 107).

Following step 107, or step 106 if the system makes a negative determination in that step, the system sequences to step 108 to begin a set of iterations over search depth and bounds, in particular performing similar operations at the upper bound and the lower bound as determined in step 104. For each bound, the system iterates on search depth (step 109). For each search depth, the system determines the sound speed using well-known methodologies (step 110). The system then determines whether the tactic is the unknown tactic and a surface duct was determined to exist in step 103 (step 111) and in response to a positive determination in step 111, and if the search depth is shallower than the conjugate depth (step 112) the upper bound is set to the layer depth (step 113) and a surface ducting flag is set (step 114). In response to a negative determination is step 111, or if the search depth is shallower than the conjugate depth (step 112), the surface ducting flag is cleared (step 115).

Following either step 114 or step 115, the system sequences to step 116 to begin determining a critical ray for the current bound and search depth under consideration. The system initially determines whether the upper bound is being considered (step 116) and in response to a positive determination an upper aimpoint is set as the upper bound (step 117) as a forwardly projecting distance at the depth of the upper bound perpendicular to and from a reference plane through the torpedo. In response to a negative determination in step 116, the lower bound is being considered and the system sets a lower like aimpoint at the lower bound (step 118). The aimpoint is a function of the distance of the search depth from the respective upper or lower bound, and is determined empirically by exhaustive computation of the optimum search angles and iterating over reasonable values of aimpoints to find the one which provides the best results. The aimpoint in one embodiment is determined by a table lookup with interpolation.

After determining the aimpoint (step 118) the system sets an acceptable coverage flag to false and an iteration counter to zero (step 119). Thereafter, the system generates a critical ray (step 120) which produces reference insomnification beam axes along ray path traces to the above discussed (in step 117) forwardly projecting aimpoints along one and the other of the target depth bounds, tests if the ratio of the range attached to the aimpoint is less than one half (step 121) and in response to a positive determination in step 121 updates the bound (step 122). In determining the critical ray (step 120) the system uses well known eigenray routines for direct path rays. Using an eigenray routine, the system generates the off-axis launch angle and the range of the ray that intersects the aimpoint at the particular upper or lower bound. If the bound of interest does not intersect the aimpoint, the eigenray routine provides maximum range attained at that depth. In updating the bound (step 122) the system moves the bound in depth in the direction of the search depth, the magnitude of the move being in increments of one-fourth the original depth separation at each iteration. This operation tempers a bias in the critical angle due to steep gradients in the sound speed profile in the direction of the bound. Following step 122, or step 121 if the system makes a negative determination in that step, the system increments the iteration counter (step 123) and determines whether the value of the iteration counter corresponds to a selected iteration termination value (in one embodiment selected to be "four") (step 124). In response to a negative determination in step 124, the system returns to step 120 to repeat the operations in steps 120–124.

When the system makes a positive determination in step 124, it sequences to step 125 to test the acceptable coverage flag. If the acceptable coverage flag is clear, no critical ray is possible which intersects any point within fifty percent of the aimpoint at a bound due to a strong gradient between the search depth and the respective upper or lower bound. As a result, the bound is ignored, since inclusion of critical rays which do not intersect the bound near the aimpoint cause an unacceptable bias in the search angle toward that bound, which, in turn, reduces the overall effectiveness of the results generated by the system. In that case, the critical ray is set to zero degrees (step 126). Following step 126, or step 125 if the system makes a negative determination in that step, the critical rays, the ranges that they intersect the aimpoints or their maximum attainable ranges, the search depths and bounds in arrays, are all saved (step 127).

The system performs steps 108 through 127 for each bound and for each search depth. After operations have been performed for each bound and for each search depth, the system performs a series of operations to generate the search angles. In that operation, the system iterates on all search depths (step 128). In each operation, the system generates the average value of the critical rays (i.e., the angles relative to the torpedo's boresight axis of the reference insomnification beam axes directed to the upper and lower target depth bounds) which intersect the aimpoints at the upper and lower bound for the given search depth to obtain an optimal ray angle (step 129), to thereby produce a homing beam offset angle (relative to the torpedo's boresight axis) optimally bracketing the bounds. The system then accounts for the weapon's attack angle by subtracting the value of the angle of attack from the optimal ray angle to obtain an adjusted optimal ray angle (step 130). The system then generates the search angle which is nearest to the optimal ray angle (step 131) and the values of the search angles are saved for use by the torpedo (step 132).

The system provides a number of advantages. For example, it accepts and processes measured environmental data without modification, allowing direct generation of search angles over a large number of environments. In addition, it accounts for a far larger number of environmental variables than, for example, the pilot ray algorithm described above.

The preceding description has been limited to a specific embodiment of this invention. It will be apparent, however, that variations and modifications may be made to the invention, with the attainment of some or all of the advantages of the invention. Therefore, it is the object of the appended claims to cover all such variations and modifications as come within the true spirit and scope of the invention.

What is claimed is:

1. A search angle selection system for determining acoustic homing beam offset angles to be used by a torpedo from a group of target depth conditions consisting of (a) unknown, (b) above an environmental thermocline, and (b) below said environmental thermocline, and with additional information of upper and lower target depth bounds, said system comprising:

a data base table including forwardly projecting aimpoints for acoustic homing at various depth levels above and below each of the torpedo's repertoire of search depths;

means for iteratively determining, for each search depth of the torpedo, a first reference insomnification beam axis angle value relative to the torpedo's boresight axis, the first reference beam axis causing a ray path which intersects the lower bound of target depth at the forwardly projecting aimpoint along said lower bound and a second reference insomnification beam axis angle value relative to the boresight axis, the second reference beam axis causing a ray path which intersects the upper bound of target depth at the forwardly projecting aimpoint along said upper bound; and means for, in a like mode of iteration, determining a third homing beam offset value relative to said boresight axis for each corresponding torpedo search depth as the average of said first and second reference angle value and storing the third homing offset angle value in an entry in said table, each entry including the search depth associated with the third homing offset angle value.

2. A system as defined in claim 1 in which the forwardly projecting aimpoints in said data base table are established by a predetermined simulation methodology.

3. A system as defined in claim 1 in which the third homing beam offset angle value generating means includes:

means, if the target depth condition is the unknown condition, for processing acoustic ray paths to determine if an environmental insonification duct adjacent the surface exists;

lower bounds comparison means responsive to a determination that an environmental insonification duct exists for determining whether the lower bound of the duct is deeper than the lower depth bound; and the third homing beam offset angle value generating means beaming operative, in response to a positive determination by the lower bounds comparison means, for employing the lower bound of the duct as the shallower lower bound.

4. A system as defined in claim 1 further comprising:

means for testing a speed of sound velocity gradient to determine whether a ray can intercept either of the upper bound or the lower bound within respective spans therealong extending to the respective forwardly projecting aimpoint, and in response to a negative determination setting the third homing beam offset angle value to zero.

5. A system as defined in claim 1 in which the forwardly projecting aimpoints are selected for each respective depth bound as a predetermined fraction of the intersection of a generated direct ray path from the search depth intersecting with the depth bound.

6. A system as defined in claim 5 in which the predetermined fraction is approximately 0.5.

7. A search angle selection method homing beam offset angles to be used by a torpedo from a group of target depth conditions consisting of (a) unknown, (b) above an environmental thermocline, and (b) below said environmental thermocline, and with additional information of upper and lower target depth bounds, said method comprising the steps of:

providing a data base table including forwardly projecting aimpoints for acoustic homing at various depth levels above and below each of the torpedo's repertoire of search depths;

iteratively determining, for each search depth of the torpedo, a first reference insomnification beam axis angle value relative to the torpedo's boresight axis, the first reference beam axis causing a ray path which intersects the lower bound of target depth at the forwardly projecting aimpoint along said lower bound and a second reference insomnification beam axis angle value relative to the boresight axis, the second reference beam axis causing a ray path which intersects the upper bound of target depth at the forwardly projecting aimpoint along said upper bound; and iteratively determining in a like mode of iteration, a third homing beam offset value relative to said boresight axis for each corresponding torpedo search depth as the average of said first and second reference angle value and storing the third homing offset angle value in an entry in said table, each entry including the search depth associated with the third homing offset angle value.

8. A method system as defined in claim 7 in which forwardly projecting aimpoints in said data base table is established by a predetermined simulation methodology.

9. A method as defined in claim 7 in which the third homing beam offset angle value is generated according to the steps of:

if the target depth condition is the unknown condition, processing acoustic ray paths to determine if an environmental insonification duct adjacent the surface exists;

if an environmental insonification duct exists, determining whether the lower bound of the duct is deeper than the lower depth bound; and in response to a determination that the lower bound of the duct is deeper than the lower depth bound by the lower bounds comparison means, employing the lower bound of the duct as the shallower lower bound.

10. A method as defined in claim 7 further comprising the step of:

testing a speed of sound velocity gradient to determine whether a ray can intercept either of the upper bound or the lower bound within the respective spans therealong extending to the respective forwardly projecting aimpoint and in response to a negative determination setting the third homing beam offset angle value to zero.

11. A method as defined in claim 7 in which the forwardly projecting aimpoints range are selected for each respective depth bound as a predetermined fraction of the intersection of a generated direct ray path from the search depth intersecting with the depth bound.

12. A method as defined in claim 11 in which the predetermined fraction is approximately 0.5.

* * * * *